United States Patent [19]

Haker et al.

[11] 3,966,344

[45] June 29, 1976

[54] ADJUSTABLE VIBRATORY ROLLER

[75] Inventors: Edwin J. Haker, Elm Grove; William H. Buelow; Charles F. Riddle, both of Brookfield, all of Wis.

[73] Assignee: Rexnord Inc., Milwaukee, Wis.

[22] Filed: Sept. 29, 1975

[21] Appl. No.: 617,605

[52] U.S. Cl. ..... 404/117; 404/133

[51] Int. Cl.[2] ..... E01C 19/38

[58] Field of Search ..... 404/117, 130, 133; 74/87; 172/40

[56] References Cited

UNITED STATES PATENTS

| | | | |
|---|---|---|---|
| 1,056,215 | 3/1913 | Reynolds | 74/87 |
| 2,464,394 | 3/1949 | Herzlinger | 74/87 |
| 2,516,335 | 7/1950 | Nevin et al. | 74/87 |
| 2,660,067 | 11/1953 | Glover | 74/87 |
| 3,145,631 | 8/1964 | Green | 404/117 |
| 3,605,583 | 9/1971 | Keppler | 404/117 |
| 3,778,177 | 12/1973 | Haker | 404/117 |
| 3,814,532 | 6/1974 | Barrett et al. | 404/117 |
| 3,909,147 | 9/1975 | Takata | 404/117 |
| R25,861 | 9/1965 | Green | 404/117 |

*Primary Examiner*—Henry S. Jaudon

*Attorney, Agent, or Firm*—Sughrue, Rothwell, Mion, Zinn & Macpeak

[57] ABSTRACT

An adjustable vibratory roller of the type used for compacting soil, asphalt, etc. A rapidly rotating vibration inducing assembly is provided within the compaction roll. The assembly comprises two weights pivotably mounted on supporting channels and a double-ended, fluid operated hydraulic cylinder connected to the weights to pivot them both simultaneously around their respective axes. The cylinder is pivotably mounted on the supporting channels, and one end of its piston rod is directly connected to one of the weights while the other end of its piston rod is connected to the other weight via a connecting link.

4 Claims, 10 Drawing Figures

FIG. 1
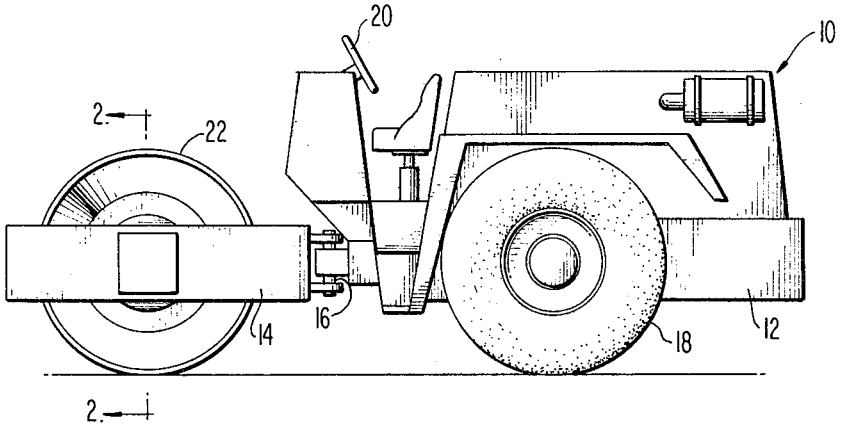
FIG. 3
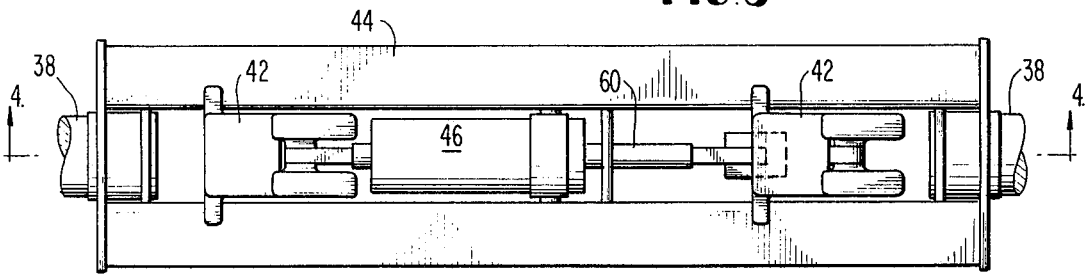
FIG. 6
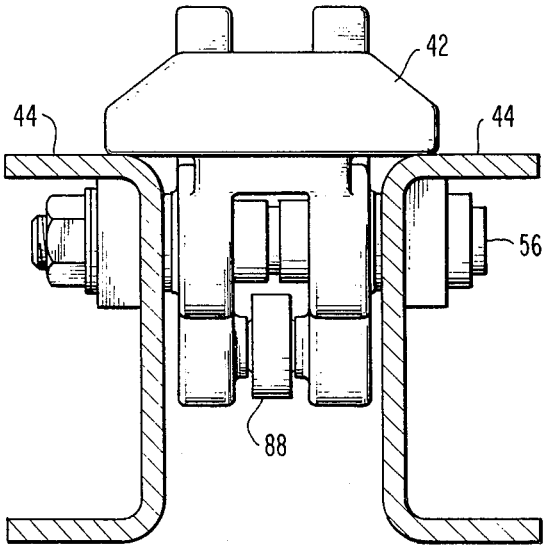
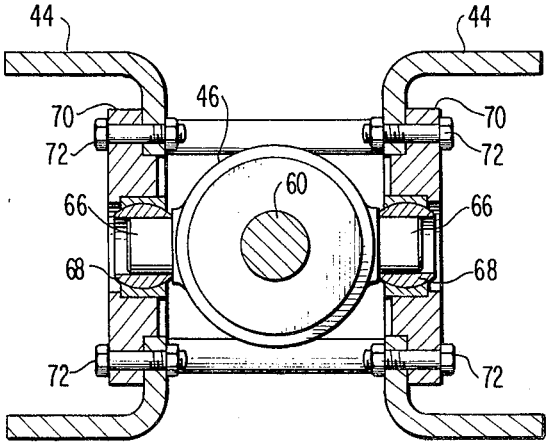
FIG. 7

ADJUSTABLE VIBRATORY ROLLER

FIELD OF THE INVENTION

The invention pertains to adjustable vibratory rollers of the type used for compacting soil, asphalt, etc.

SUMMARY OF THE INVENTION

This invention consists of an adjustable vibratory roller of the type used for compacting soil, asphalt, etc. A rapidly rotating vibration inducing assembly is provided within the compaction roll. The assembly comprises two weights pivotably mounted on supporting channels and a double-ended, fluid operated hydraulic cylinder connected to the weights to pivot them both simultaneously around their respective axes. The cylinder is pivotably mounted on the supporting channels, and one end of its piston rod is connected to the other weight via a connecting link.

BRIEF DESCRIPTION OF THE DRAWINGS

FIG. 1 is a side view of a preferred embodiment of this invention.

FIG. 3 is a view taken along the line 3—3 in FIG. 2, except that the weights are shown in the extended position.

FIG. 6 is a sectional view taken along the lines 6—6 in FIG. 4.

FIG. 7 is a sectional view taken along the lines 7—7 In FIG. 4.

DETATILED DESCRIPTION OF THE PRESENTLY PREFERRED EMBODIMENT

Figure 2:
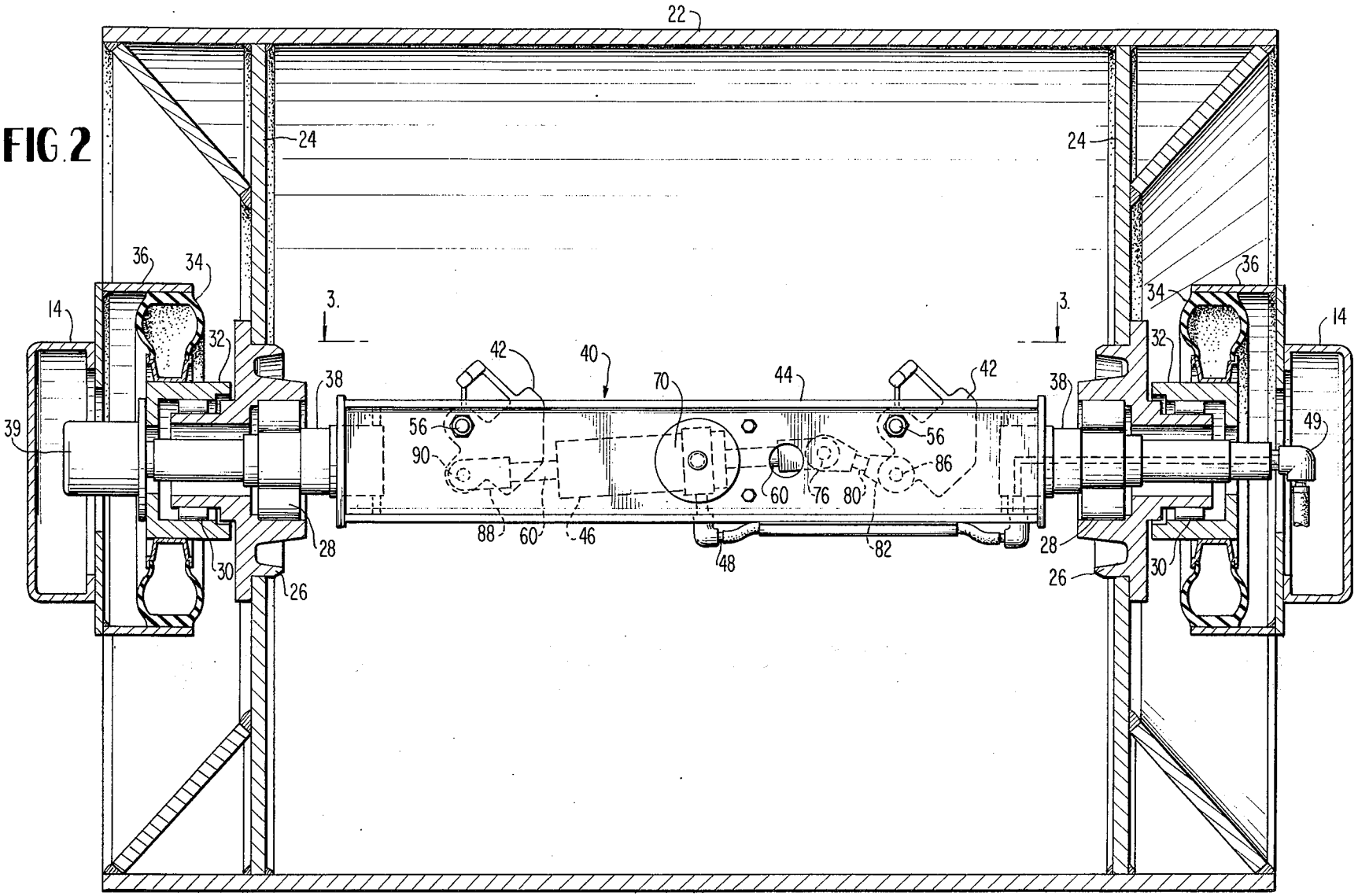
FIG. 2 is a sectional view of the apparatus shown in FIG. 1 taken along the line 2—2 in FIG. 1 and showing the weights in the course of a movement between the operative positions.

The self-propelled vibratory roller 10 shown in FIG. 1 includes frames 12 and 14 which are connected by a pin 16 for the relative pivotal steering movement about a central vertical axis. Rubber tired wheels 18 (only one of which is shown) support frame 12, which carries an engine 94 (shown only in FIG. 10) and an operator's control station 20. The frame 14 surrounds a compaction roll 22 which is rotatably mounted on the frame 14.

As shown in FIG. 2, the compaction roll 22 is provided at each end with an end disc 24 on which is mounted a hub 26. Each of the hubs 26 has an axially inner bearing 28 and an axially outer bearing 30. Each of the outer bearings 30 supports a hub 32 on which a resilient cushion member 34 is mounted. Each of the cushion members 34 is securely press fitted into a circular housing 36 which is mounted on the frame 14. The inner bearings 28 journal a vibration inducing assembly 40 which includes two oppositely extending coaxial stepped stub shafts 38 mounted for rotation about an axis which is coincident with the axis of the compaction roll 22. At the outside end of one of the stepped shafts 38 a motor 39 is mounted on the hub 32. The motor 39 is connected to and rotates the assembly 40 independently of the motion of the compaction roll 22.

The vibration inducing assembly 40 additionally comprises two weights 42 pivotably mounted between supporting channels 44 and a double-ended, fluid-operated hydraulic cylinder 46 which is also mounted between the supporting channels 44. The cylinder 46 is located between the weights 42 and is connected to the weights 42 to pivot them about their respective axes. The cylinder 46 is actuated by fluid pressure communicated to it via a path of fluid communication 48 which passes through one of the stepped shafts 38 to a rotary joint 49 and thence to the interior of the frame 14, from where it can be made to communicate with a suitable source of fluid pressure under control of the control station 20 by any suitable means. One such means is described hereinafter in connection with FIG. 10.

Figure 9:
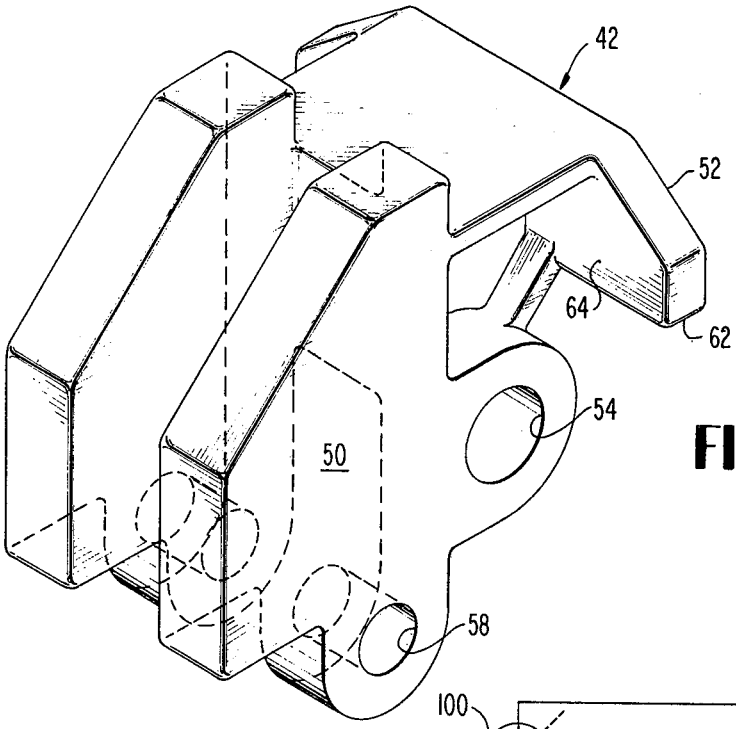
FIG. 9 is a perspective view of one of the weights used in the preferred embodiment of this invention.

One of the weights 42 is shown in perspective in FIG. 9. It comprises two irregularly shaped slabs 50, a stop 52 having working faces 62 and 64, a bore 54 by which it may be pivotably mounted between the supporting channels 44 by means of a trunnion 56 (shown in FIG. 2), and a bore 58 by which it may be connected to the appropriate piston rod of the cylinder 46. In the commercial embodiments of applicants' invention, the weights 42 weigh about 31 pounds each.

Figure 4:
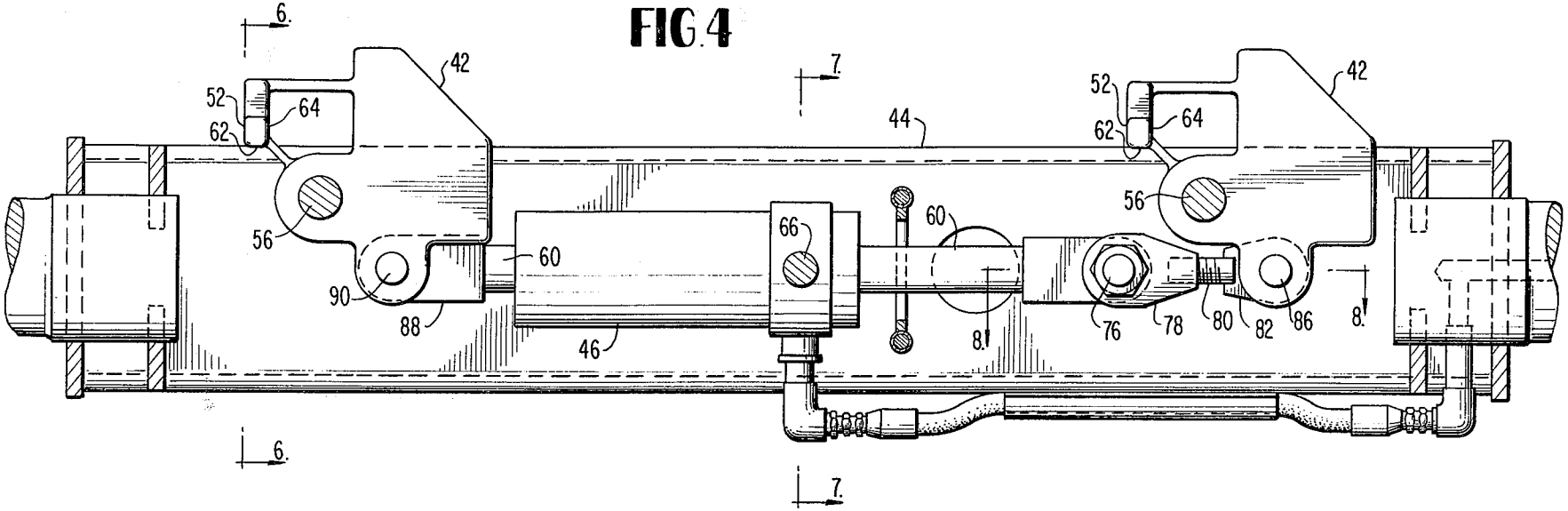
FIG. 4 is a sectional view taken along the lines 4—4 in FIG. 3.
Figure 5:
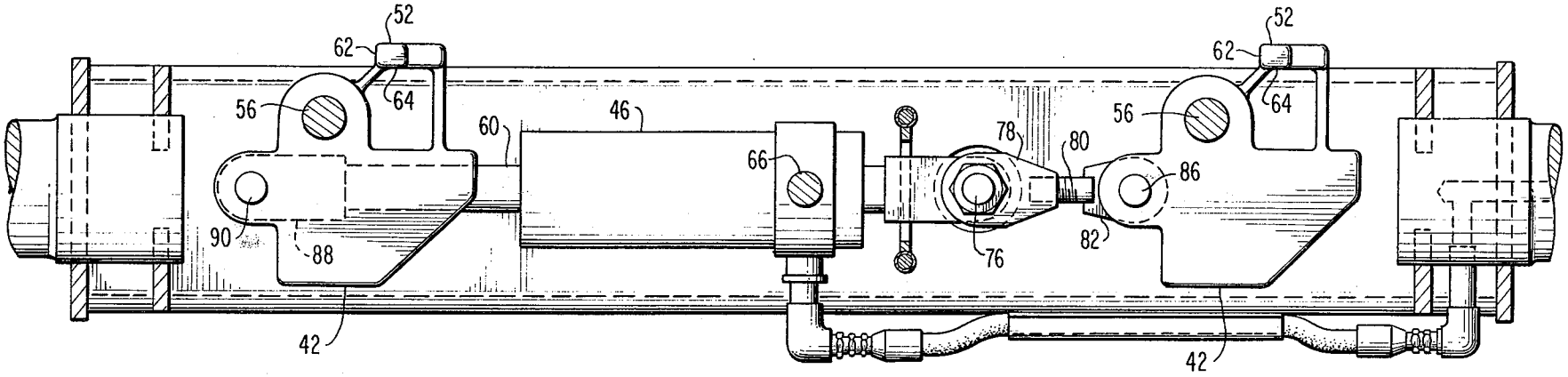
FIG. 5 is a sectional view taken in the same position as FIG. 3, but showing the weights in the retracted, rather than the extended, position.

The functioning of the assembly 40 can be best understood from FIGS. 2, 4, and 5. FIG. 4 shows the weights 42 in their extended position, FIG. 2 shows the weights 42 in an intermediate position, and FIG. 5 shows the weights 42 in their retracted position. In FIG. 4, the double-ended piston rod 60 of the cylinder 46 is extended to the right, causing the weights 42 to pivot in the counter-clockwise direction around their trunnions 56 until the faces 62 of the stops 52 abut against the one of the flanges of each of the supporting channels 44. In FIG. 5, the piston rod 60 is extended to the left, causing the weights 42 to pivot in the clockwise direction around the trunnion 56 until the face 64 of the stops 52 abuts against the same flanges of the two supporting channels 44. It is readily apparent that the circular path traced by the center of mass of the weights 42 as they move around the axis of rotation of the stepped shafts 38 has a smaller diameter when the weights 42 are in the FIG. 5 position than when they are in the FIG. 4 position.

Figure 8:
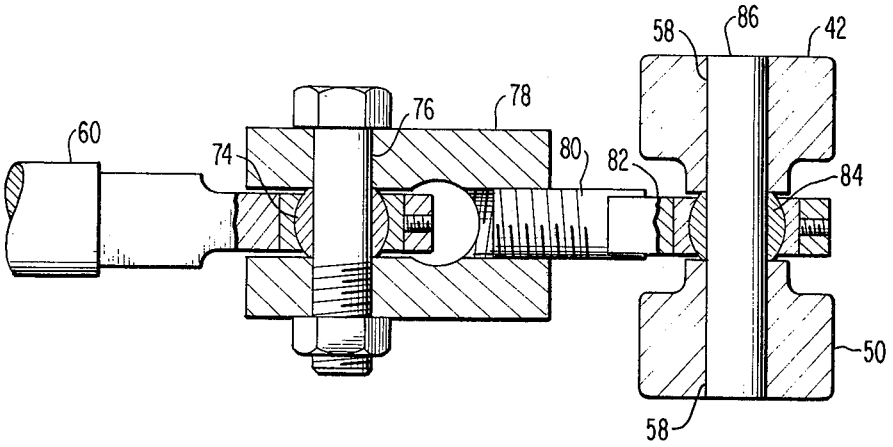
FIG. 8 is a sectional view taken along the lines 8—8 in FIG. 4.

As may be seen in FIG. 7, coaxial stub shafts 66 are mounted on the sides of the cylinder 46, and the stub shafts 66 are journaled in bearings 68. The bearings 68 are mounted in the mounting plates 70, which are in turn attached to the support channels 44 by bolts 72. The bearings 68 permit the cylinder 46 to pivot around the axis of the stub shafts 66, but they do not permit it to translate in any direction. However, since the trunnions 56 extend in fixed position between the supporting channels 44, the axes of the bores 58 trace arcs as the weights 42 move back and forth between their FIG. 4 and FIG. 5 positions. The piston rod 60 translates longitudinally within the cylinder 46, but it cannot translate radially within it. Accordingly, the radial motion of the axis of the bores 58 must be accommodated elsewhere, and a link for so doing is shown in FIG. 8. As may be seen in that figure, a ball and socket bearing 74 is mounted on one end of the piston rod 60. A bolt 76 secures the ball of the ball and socket bearing 74 to a connecting block 78. A connecting rod 80 is then screwed into the connecting block 78, the threads in the connecting block 78 being provided so that the length of the link is adjustable. A housing 82 is attached to the end of the connecting rod 80 remote from the connecting block 78, and a ball and socket bearing 84 is mounted in the housing 82. A connecting pin 86 is press fit in the bores 58 and extends through the ball of the ball and socket bearing 84 to secure the same between the slabs 50 of the right-hand weight 42. Accordingly, the radial component of the arcurate motion of the axis of the bore 58 on the right-hand weight 42 is taken up by the pivoting motion of the connecting block 78, the connecting rod 80, and the housing 82 about the axis of the bolt 76.

A similar link for accomodating radial motion does not have to be provided at the other end of the piston rod 60 because the radial motion of the other end can be accommodated by the pivoting of the piston rod 60 around the stub shafts 66. As may be best seen in FIGS. 2, 4, and 5, the end of the piston rod 60 remote from the link simply mounts a bearing plate 88 which carries a bearing (not shown) in which a connecting pin 90 equivalent in function to the connecting pin 86 is journaled. The connecting pin 90 is press fitted into the bore 58 in the left-hand weight 42, and the radial motion of the axis of the bore 58 in the lft-hand weight 42 is taken up by the pivoting motion of the piston rod 60 about the axis of the fixed stub shafts 66. (Note that the axis of the bolt 76 is *not* radially fixed, since it moves in an approximately arcuate path when the piston rod 65 moves axially.)

Figure 10:
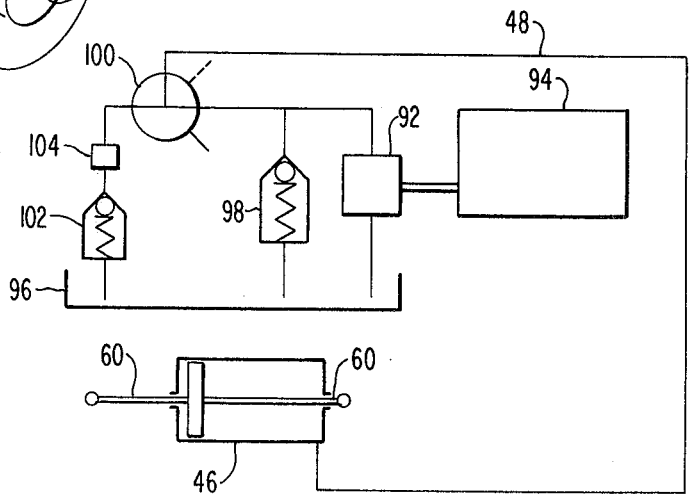
FIG. 10 is a schematic diagram of the hydraulic circuit used in the preferred embodiment of this invention.

The weights 42 are held inward by fluid pressure introduced through the tube 48 by the basic hydraulic system as shown in FIG. 10. The pump 92, driven by the engine 94, has a controlled output pressure of 800–1000 p.s.i. The operator of the vehicle can control the pressure to allow the weights to move outward gently under the influence of the centrifugal force caused by the rotation of the vibration inducing assembly 40 or to pull the weights back inwards against that force. Suitable interlocks (not shown) are provided to require the speed of rotation of the assembly 40 to be reduced before the weights 42 are allowed to move outward.

The pump 92 draws its fluid from a hydraulic reservoir 96 and its output is connected to the reservoir 96 through the over-load safety pressure-relief valve 98 and to the manual three-way valve 100. When valve 100 is in the position shown, the output of pump 92 is also connected to cylinder 46 by the path of fluid communication 48 and moves the piston rod 60 to the left as required. The output pressure of pump 92 then serves to hold the weights 42 in their inward position. When the valve 100 is moved to its other position (turned one-quarter turn counter-clockwise) the output of pump 92 as well as the fluid from cylinder 46 is allowed to return to reservoir 96 through the pressure relief valve 102. The pressure relief valve 102 is provided merely to maintain a nominal back pressure in the hydraulic circuit. The manually adjustable orifice 104 is optionally provided between valves 100 and 102 if desired or necessary to control the rate of outward movement of the weights.

In normal operation, the vibration inducing assembly 40 rotates at 1100 to 2200 r.p.m. when the weights 42 are in and 1100 to 1800 r.p.m. when the weights 42 are out. Most compaction work is done with the weights 42 outward.

CAVEATS

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

In the following claims, it will be recognized of course that the terms right-hand and left-hand are used only for convenience and that the claimed combinations could equally well be designed in allochiral form.

What is claimed is:

1. Apparatus for compacting soil such as for roadways comprising a roll having central bearings at the ends thereof, means for traversing the roll over the soil, a vibration inducing assembly having end shafts rotatably supported in said bearings and laterally spaced parallel beams, said beams joining said end shafts and having interconnecting trunnions adjacent to said shafts, a weight pivotally mounted on each trunnion and pivotally movable between radially spaced inner and outer positions having reference to the rotational axis of said assembly, each weight having a connecting pin which intersects said axis when the weight is in either of said positions, a hydraulic cylinder located between said connecting pins and supported by and between said beams, said hydraulic cylinder having a double-ended piston rod with its opposite ends respectively connected to the connecting pins of the weights whereby fluid under pressure in one end of said cylinder is effective to move the weights from their outer to their inner positions, and the longitudinal axis of said cylinder and piston rod being substantially coincident with their rotational axis whereby shock and vibration forces applied thereto are minimized.

2. In apparatus for compacting soil such as for roadways comprising a roll having central bearings at the ends thereof, means for traversing the roll over the soil, a vibration inducing assembly having ends rotatably supported in said bearings and an eccentric weight near each such end, drive means to rotate the assembly, and hydraulic means to move each weight from a radially outer to a radially inner position and to control the movement of the weights centrifugally from their inner to their outer positions whereby two different amplitudes of roll vibration are provided, the improvement wherein:

1. said vibration inducing assembly comprising
   a. shafts rotatably supported in said bearings,
   b. laterally spaced parallel beams which join said shafts, and
   c. right and left hand weights supported by and between said beams near the corresponding shaft, the two weights being pivotally movable on parallel axes which are transverse respecting the rotational axis of the assembly and between radially inner and outer positions respecting said axis, each weight having a connecting pin parallel to its pivotal axis, each pin having a left-hand position intersecting the rotational axis of the assembly when the weight is in its inner position and a right-hand position intersecting said axis when the weight is in its outer position and 2. said hydraulic means comprises a. a hydraulic cylinder disposed between said beams, b. spaced bearings carried by the corresponding beams and supporting the right hand end of the cylinder for pivoting on an axis parallel to the pivotal axes of said weights, c. a hydraulic line to the right hand end of the cylinder, and d. a double-ended piston rod movable between left and right hand positions, the right hand rod end having a link connecting the same with connecting pin of the right hand weight, the left hand rod end being connected directly to the connecting pin of the left hand weight, said last named connecting pin and said spaced bearings being disposed to provide the firm support of the cylinder and piston rod on the rotational axis of the assembly when the weights are in either their inner or their outer positions.

3. The apparatus and improvement of claim 2 wherein each weight includes abutments which engage said beams and limit the pivotal movement of said weights to define respectively their inner and outer positions and wherein said link is adjustable in length.

4. In a vibratory roller of the type used for compacting soil, etc., comprising a compacting roll and means for driving the roll over surfaces to be compacted, the improvement comprising an adjustable vibration inducing assembly located within the compacting roll, said adjustable vibration inducing assembly comprising:

a. supporting element extending axially through the compacting roll;

b. means for rotating said supporting element about an axis coincident with the axis of the compacting roll;

c. a first weight pivotably mounted on said supporting element;

d. a second weight pivotably mounted on said supporting element at a distance from said first weight;

e. a double-ended, fluid operated hydraulic cylinder pivotably mounted on said supporting element in between said first and second weights, said cylinder having a piston rod which is pivotably connected to said first weight at one end and which is connected to said second weight by a link at the other end; and f. means for actuating said cylinder.

* * * * *